United States Patent [19]

Peterman

[11] Patent Number: 4,693,184

[45] Date of Patent: Sep. 15, 1987

[54] SAFETY FLOOR

[75] Inventor: Robert J. Peterman, Hartland, Wis.

[73] Assignee: Spacesaver Corporation, Fort Atkinson, Wis.

[21] Appl. No.: 839,966

[22] Filed: Mar. 17, 1986

[51] Int. Cl.[4] ..... A47B 53/00

[52] U.S. Cl. ..... 104/295; 104/288

[58] Field of Search ..... 104/287, 288, 295, 296, 104/297; 312/198-201; 52/1, 480; 267/42-44, 164, 158

[56] References Cited

U.S. PATENT DOCUMENTS

| | | | |
|---|---|---|---|
| 1,380,615 | 6/1921 | Weaver | 293/120 |
| 1,710,175 | 4/1929 | Mascuch | 293/120 |
| 2,172,000 | 9/1939 | Wenker | 267/164 |
| 2,743,487 | 4/1951 | Kuhlman | 52/480 |
| 3,829,189 | 8/1974 | Staller | 104/295 |
| 3,957,323 | 5/1976 | Tucker et al. | 104/288 |
| 4,017,131 | 4/1977 | Camenisch | 104/295 |

*Primary Examiner*—Randolph A. Reese
*Assistant Examiner*—Russell D. Stormer
*Attorney, Agent, or Firm*—Fuller, Puerner & Hohenfeldt

[57] ABSTRACT

A low profile safety floor for electrically powered mobile storage systems includes one or more elongated panels that span the building floor between the system rails. To each end of the panels are mounted a pair of leaf springs and a safety switch. The panels are supported above the rails by means of the leaf springs. When a person steps onto the safety floor, the panel is deflected downwardly so that a safety switch is actuated. Positive stops limit the approach of the panel toward the rails. Switch actuation deenergizes the electric motor drive powering the carriages. To prevent panel sag, the panels are manufactured as wood and steel laminates. To further inhibit sagging, the panels are forced into a permanently upwardly convex shape at manufacture.

5 Claims, 5 Drawing Figures

SAFETY FLOOR

BACKGROUND OF THE INVENTION

1. Field of the Invention

This invention pertains to safety apparatus, and more particularly to safety devices for stopping a moving mobile storage carriage.

2. Description of the Prior Art

Mobile storage systems are well known. They have gained widespread acceptance because of their ability to conserve valuable space in libraries and offices.

Many mobile storage systems employ electric power to move the movable carriages along the system rails. Although electrically powered carriages are convenient and easy to use, they present a certain disadvantage in that a person may be in an aisle between carriages unknown to a second person who desires to move the carriages. To protect a person in an aisle, various safety equipment has been developed. The primary function of the safety equipment is to stop a moving carriage when the particular safety device is actuated, and also to prevent startup of carriages at rest. An example of a safety stop device for mobile storage systems may be seen in U.S. Pat. No. 4,616,888. While the safety device of the foregoing patent application is generally satisfactory, certain improvements thereto have been developed. Further, some user applications occasionally arise in which a different form of safety equipment is more suitable than available equipment. Thus, a variety of safety devices are required to meet the needs of mobile storage system users.

SUMMARY OF THE INVENTION

In accordance with the present invention, reliable and inexpensive safety equipment is provided that deenergizes the power to an electrically powered mobile storage system in response to potential danger to a person adjacent a movable carriage. This is accomplished by apparatus that includes modular floor panels having switches that are actuated by the weight of the person on the panels.

The panels extend between low profile rails of the mobile storage system, which may have a spread as great as 81 inches. The opposite ends of the panels are supported by leaf springs that rest on rail horizontal support surfaces. Each panel edge also includes a safety switch that forms a part of the circuit controlling the electric motors for driving the movable carriages. The springs have a sufficiently high spring constant to support the panel edges above the rail support surfaces and maintain the switches in a normally closed mode. In that situation, the circuits to the drive motors are closed, and the system can be operated in fashion that is well known in the art.

However, the weight of a person who walks onto the safety floor of the present invention deflects the leaf springs sufficiently to actuate at least one of the safety switches against the rail. The switch functions to open the circuit controlling the carriage drive motors, thus stopping moving carriages or preventing stationary carriages from starting. When the person walks off the safety floor, the leaf springs return the panel to the raised condition and thereby deactuate the switch to the normally closed mode.

Further in accordance with the present invention, the panels are designed to resist sagging for extended times. For that purpose, the panels are constructed as laminates of wood and steel. Preferably, the wood forms the major component of the laminate, and only a relatively thin steel reinforcing strip is required to provide anti-sag properties. To further inhibit sagging, the panels are fabricated so that the planes thereof are upwardly convex. The center of the panel is preferably approximately 0.38 inches high relative to the edges. Thus, the panel does not bottom out at the center on the building floor, which would make the safety floor of the present invention ineffective.

Other objects and advantages of the invention will become apparent to those skilled in the art upon reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
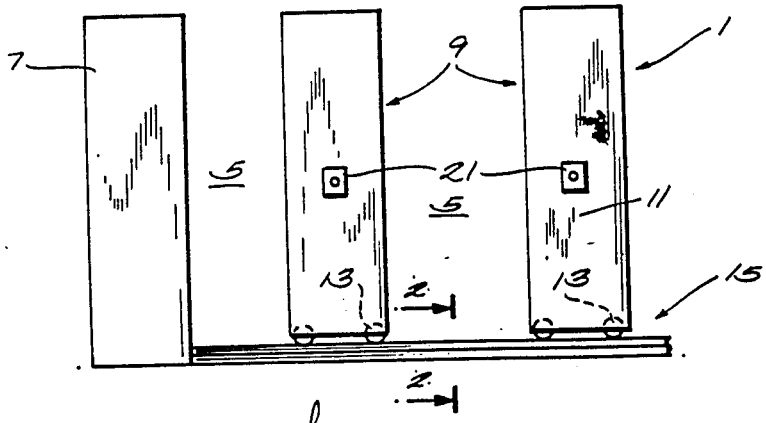
FIG. 1 is a side view of a typical mobile storage system that advantageously includes the present invention.
Figure 2:
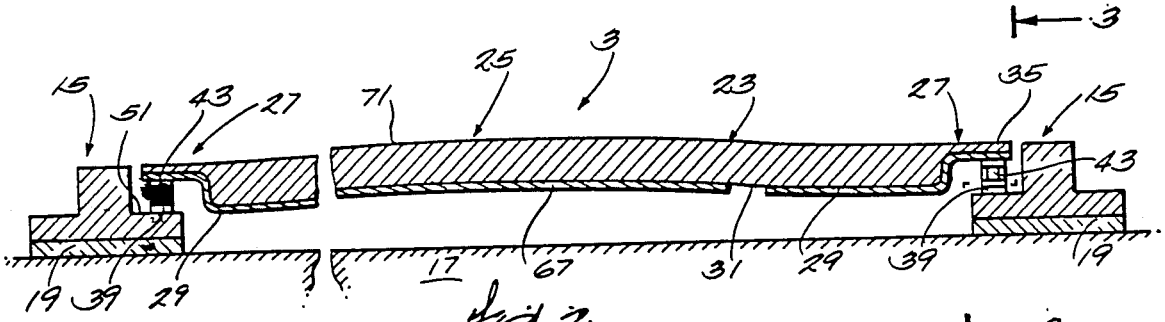
FIG. 2 is a sectional view taken along lines 2—2 of FIG. 1.

Referring to FIGS. 1 and 2, a mobile storage system 1 is illustrated that includes the safety floor 3 of the present invention. The safety floor is especially useful for safeguarding personnel standing in the aisles 5 of the mobile storage system 1, but it will be understood that the invention is not limited to mobile storage system applications.

As shown in FIG. 1, a typical mobile storage system includes one or more stationary shelf units 7 and one or more movable carriages 9. The carriages include a frame 11 that is mounted on wheels 13 for longitudinal motion along two or more parallel rails 15. The rails 15 are secured to the building floor 17 in known manner, such as by embedding them in the floor 17. Alternately, as shown in FIG. 2, the rails may be placed on top of the floor and retained in place with grout 19. For user convenience, the wheels 13 of the carriages are frequently powered by suitably controlled electric motors, not shown, as is known in the art. A conventional switch 21 is typically mounted to each carriage for activating the motor drive circuit to power the carriages along the rails, FIG. 1.

In accordance with the present invention, the low profile safety floor 3 is incorporated into the mobile storage system 1 for stopping a movable carriage 9 and for preventing startup of a stationary carriage when a person is standing on the safety floor. The safety floor extends transversely between the rails 15 for the full length thereof. See FIG. 2.

The safety floor 3 is composed of individual low profile modules 23. The modules 23 generally have widths approximately 24 inches to 48 inches, which is the module dimension in the direction of carriage longitudinal motion. The lengths of the modules are essentially the transverse distances between the rails, which may vary from approximately 36 inches up to approximately 81 inches. Any number of modules may be utilized; the number is determined by the length of the rails.

Figure 3:
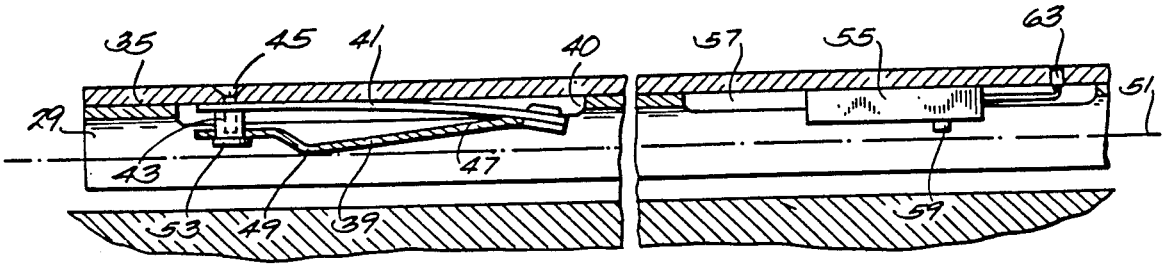
FIG. 3 is a view, partially in section, taken along lines 3—3 of FIG. 2.
Figure 4:
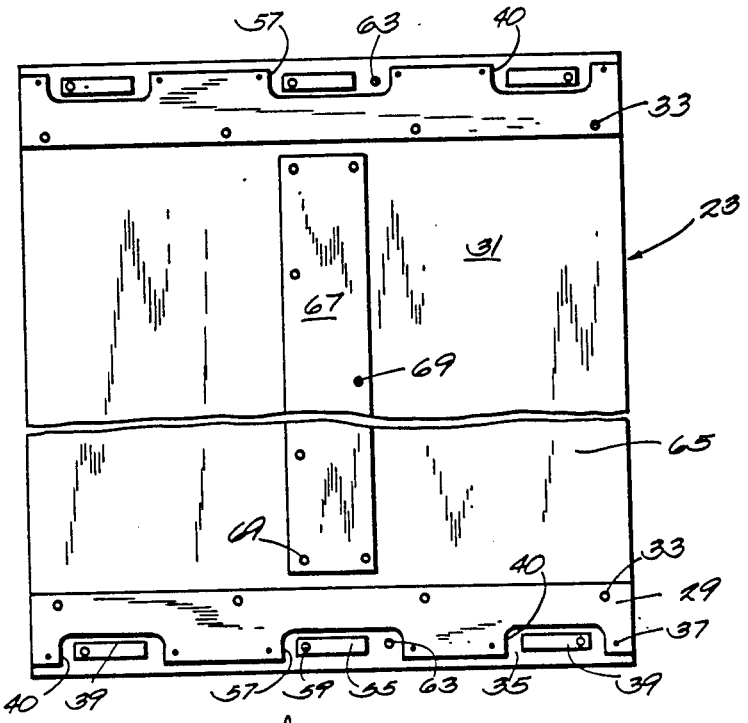
FIG. 4 is a bottom view of the safety floor of the present invention.

In the preferred embodiment, each module 23 comprises a thin panel 25 supported at opposite ends by a safety bracket assembly 27. Each safety bracket assembly 27 includes a Z-shaped bracket 29 that is secured to the panel underside 31 by conventional fasteners 33, FIG. 4. Referring to FIGS. 2, 3, and 4, each safety bracket assembly further includes a plate 35 fastened to the bracket 29 by fasteners 37.

To resiliently support the safety floor 3 on the rails 15, each safety bracket assembly 27 is provided with a plurality of leaf springs 39. Although the panel 23 may be stably supported by three leaf springs 39, it is preferred that two leaf springs be employed on each end of the panel. As best seen in FIG. 3, each leaf spring has a first leaf 41 that is retained on the underside of the plate 35 by an internally threaded retainer 43 in combination with a flathead screw 45. The leaf springs pass through notches 40 cut in the bracket 29. (See FIG. 4) The second leaf 47 of each leaf spring is guided on the retainer 43, which passes through a hole in the free end of the leaf 47, FIG. 3. The second leaf is formed with an elbow 49 that rests on a rail horizontal support surface 51. The leaf springs are designed with a spring constant sufficient to resiliently support the panels 25 such that there is approximately 0.12 inches of clearance between the retainer head 53 and the rail surface 51.

To control the electric motors powering the movable carriages 9 when a person steps on the safety floor 3, the safety floor includes a safety switch 55 incorporated as a part of each safety bracket assembly 27. As best shown in FIGS. 3 and 4, the safety switches 55 are mounted to the underside of the plates 35 and pass through appropriately sized cutouts 57 in the brackets 29. Each safety switch includes a lifter 59 that is located approximately 0.06 inches above the rail surface 51 when no person is standing on the panel and the leaf springs 39 support only the panel weight. The safety switches are of the normally closed type, so that the electric motor circuitry for driving the movable carriages is energized when the lifter 59 is in the deactuated condition of FIG. 3.

Figure 5:
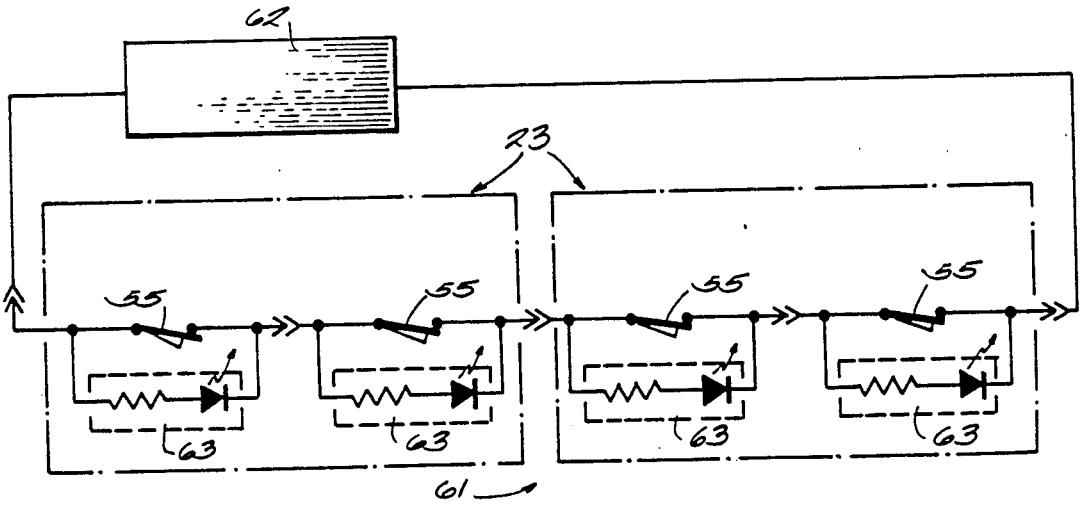
FIG. 5 is a schematic diagram of the electric circuit of the safety floor of the present invention.

Referring to FIG. 5, a schematic diagram of the electric circuit 61 that includes the safety switches 55 is illustrated. Reference numeral 62 indicates a carriage drive control that is actuated by the safety floor 3 of the present invention. The circuit 61 is shown to include two modules 23, but it will be appreciated that any number of modules can be incorporated into the safety floor. The safety switches of all the modules are wired in series, so that actuation of any safety switch opens the circuit 61 to signal the control 62 to deenergize the carriage motors. In FIGS. 3, 4, and 5, reference numerals 63 indicate light emitting diodes that are associated with each safety switch. A light emitting diode 63 is wired in parallel with each safety switch. Accordingly, if a switch is opened for any reason, including a malfunction, the associated light emitting diode will light. Thus, the light emitting diodes serve primarily as trouble shooting aids.

Further in accordance with the present invention, the panels 23 are constructed in a novel manner that greatly reduces the tendency of the panel centers to sag while still providing a low profile floor. In the illustrated construction, the panels are constructed as laminates of wood and steel. Referring to FIGS. 2 and 4, the wood portion of the panel is indicated by reference numeral 65. Preferably, the wood portion 65 is approximately 0.88 inches thick, which is sufficient to provide adequate strength and rigidity. Secured to the underside 31 of the wood portion is a steel reinforcing strip 67. Both screws 69 and glue are preferably utilized to secure the reinforcing strip 67 to the wood portion. Without the steel strip, the wood portion would sag with time due to creep. The steel strip, being a substantially perfect elastic material, prevents creep from occurring.

To further prevent the panels 25 from bottoming at the centers thereof on the floor 17, the panels are formed into permanently upwardly convex configurations as the reinforcing strips 67 are secured to the wood portions 65 by the screws 69 and glue. Preferably, as shown in FIG. 2, the panel centers 71 are approximately 0.38 inches higher than the edges. The novel construction of the panels of the present invention permits them to function satisfactorily for rail spreads up to about 81 inches, and yet the panel is only 1 inch thick.

The safety floor 3 is installed by positioning the modules 23 adjacent each other for the length of the rails 15. The safety switches 55 are deactuated to the normally closed condition because the leaf springs 39 support the panels 25 such that the switch lifters 59 are above the rail surfaces 51. The switches of all the modules are connected electrically in series, FIG. 5, by conventional plugs, not shown. As long as all the switches remain unactuated, the drive control 62 allows the carriage motors to operate and move the carriages 9 along the rails. When a person walks into an aisle 5 and stands on a module 23 of the present invention, her weight deflects the leaf springs, and the module lowers relative to the rails. The lifter 59 of at least one safety switch contacts the rail support surface 51 and actuates the switch to the open condition. Actuating any switch to the open condition interrupts the carriage drive motor circuit in control 62 to deenergize the carriage drive motors and stop the carriages, or to prevent startup of a carriage at rest. The retainer 43 serves as a positive stop for the approach of the modules toward the rail surfaces 51 as the leaf springs deflect, thereby preventing damage to the switches. Upon a safety switch being actuated, the light emitting diode 63 associated with that switch becomes energized to light and indicate which switch has been opened. Also, if a switch malfunctions, the appropriate light emitting diode will light and thereby perform its primary function as a diagnostic aid. When the person leaves the aisle and walks off the safety floor, the leaf springs force the panel upwardly with respect to the rail, the switch lifter loses contact with the rail to return the switch to the deactuated normally closed mode, and the circuit 61 closes to permit control 62 to energize the carriage drive motors.

Thus, it is apparent that there has been provided, in accordance with the invention a safety floor that fully satisfies the objects and advantages set forth above. While the invention has been described in conjunction with specific embodiments thereof, it is evident that many alternatives, modification, and variations will be apparent to those skilled in the art in light of the foregoing description. Accordingly, it is intended to embrace all such alternatives, modifications, and variations as fall with the spirit and broad scope of the appended claims.

I claim:

1. A safety module for sensing the presence of a force applied thereto comprising:

a. a generally flat rectangular panel;

b. a leaf spring attached to each corner of the panel for resiliently supporting the panel above a support surface and for deflecting toward the support surface under the influence of the force, each leaf spring having a first free end secured to the panel and a second free end in support contact with the support surface and having a hole therethrough; and c. a rigid elongated retainer associated with each spring, each retainer being secured to the panel and slidingly passing through the hole in the spring second free end for slidingly guiding the second free end for contacting the support surface as the panel deflects relative to the support surface.

2. The module of claim 1 wherein the retainer defines a head adapted to retain the spring second free end on the retainer, the retainer head being spaced a predetermined distance from the panel and adapted to contact the support surface to limit the deflection of the panel toward the support surface.

3. In combination with a mobile storage system having at least one movable carriage mounted for movement under electrical power along parallel rails on a building floor, the rails having horizontal support surfaces, a low profile safety floor for sensing the presence of a person adjacent the carriage comprising:

a. at least one generally flat panel substantially spanning the distance between the rails, the panel terminating over the rails support surfaces;

b. a leaf spring attached to each corner of the panel for resiliently supporting the panel on the rail support surfaces at a first predetermined distance thereabove when no person is standing on the panel and for deflecting to cause the panel to approach the rail support surfaces when a person is standing on the panel, each leaf spring having a first free end secured to the panel and a second free end in support contact with a rail support surface, each leaf spring second free end having a hole therethrough;

c. a retainer secured to the panel in cooperation with each leaf spring first free end, each retainer being adapted to slidingly pass through the leaf spring second free end to slidingly guide the spring second free end when the panel is deflected toward the rail support surface;

d. safety switch means attached to the panel for being actuated by the rail support surface when the panel is deflected; and e. control means activated by the actuated safety switch means for deenergizing the electrical power to the movable carriages.

4. The safety floor of claim 3 wherein the panel is fabricated as a two-ply laminate having a flat wood layer for providing strength and rigidity and a flat steel reinforcing layer in facing contact with the wood layer for providing resistance to creep and sagging of the panel, and wherein the plane of the laminated panel is uniformly upwardly convex to thereby prevent the panel from bottoming out in the center thereof on the building floor.

5. In combination with a mobile storage system having at least one movable carriage mounted for movement under electrical power along parallel rails on a building floor, the rails having horizontal support surfaces, a low profile safety floor for sensing the presence of a person adjacent the carriage comprising:

a. at least one generally flat panel substantially spanning the distance between the rails;

b. spring means attached to the panel for resiliently supporting the panel on the rail support surfaces at a first predetermined distance thereabove when no person is standing on the panel and for deflecting to cause the panel to approach the rail support surfaces when a person is standing on the panel, the spring means comprising:

i. a leaf spring attached adjacent to each corner of the panel, each leaf spring having a first free end secured to the panel and a second free end in support contact with a rail support surface and having a hole therethrough; and ii. a positive stop attached to the panel in operational relationship to each spring to limit the deflection of the springs when a person stands on the panel, the positive stop being a retainer secured to the panel and passing through the hole in the spring second free end for guiding the second free end, wherein the retainer defines a head adapted to restrain the motion of the spring second free end on the retainer, the retainer head being spaced from the panel and adapted to contact the rail support surface to limit the approach of the panel toward the rail support surface to a second predetermined distance thereabove;

c. safety switch means attached to the panel for being actuated by the rail support surface when the panel is deflected; and d. control means activated by the actuated safety switch means for deenergizing the electrical power to the movable carriages.

* * * * *